US011821311B2

(12) United States Patent
Wheeler et al.

(10) Patent No.: US 11,821,311 B2
(45) Date of Patent: Nov. 21, 2023

(54) TILTING ANTI-ROTATION SYSTEM

(71) Applicant: Halliburton Energy Services, Inc., Houston, TX (US)

(72) Inventors: Fraser A. Wheeler, Edmonton (CA); Geoffrey Andrew Samuel, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/308,529

(22) PCT Filed: Jul. 28, 2016

(86) PCT No.: PCT/US2016/044475
§ 371 (c)(1),
(2) Date: Dec. 10, 2018

(87) PCT Pub. No.: WO2018/022060
PCT Pub. Date: Feb. 1, 2018

(65) Prior Publication Data
US 2020/0308913 A1 Oct. 1, 2020

(51) Int. Cl.
*E21B 7/06* (2006.01)

(52) U.S. Cl.
CPC ..... *E21B 7/062* (2013.01)

(58) Field of Classification Search
CPC ..... E21B 7/062; E21B 23/00
See application file for complete search history.

(56) References Cited

U.S. PATENT DOCUMENTS 4,739,843 A * 4/1988 Burton ..... E21B 17/10 175/325.4
4,886,130 A * 12/1989 Evans ..... E21B 7/06 175/73
5,275,239 A 1/1994 Obrejanu
5,649,603 A * 7/1997 Simpson ..... E21B 23/14 175/323
6,244,361 B1 6/2001 Comeau et al.
7,234,544 B2 6/2007 Kent
7,306,058 B2 12/2007 Cargill et al.
2002/0014335 A1* 2/2002 Doyle ..... E21B 23/01 166/206
2002/0185314 A1 12/2002 Cargill et al.
2005/0098353 A1 5/2005 Maxwell et al.
2011/0031025 A1* 2/2011 Kulkarni ..... E21B 10/62 175/76
2016/0258221 A1* 9/2016 Macha ..... E21B 10/325
2017/0122043 A1* 5/2017 Shahipassand ..... E21B 17/1078

FOREIGN PATENT DOCUMENTS

WO 2018022060 A2 2/2018

* cited by examiner

*Primary Examiner* — Theodore N Yao
(74) *Attorney, Agent, or Firm* — Benjamin Ford; Parker Justiss, P.C.

(57) ABSTRACT

Provided is an anti-rotation system and method of operating a downhole tool. The anti-rotation system, in one embodiment, includes a housing defining a longitudinal axis, and a carriage mounted within the housing, the carriage including at least one anti-rotation blade configured to engage a formation and resist rotation of the housing about the longitudinal axis. The carriage, in accordance with this embodiment, is configured to rotate about a carriage axis and tilt the at least one anti-rotation blade from a first extended position to a second at least partially retracted position.

9 Claims, 14 Drawing Sheets

TILTING ANTI-ROTATION SYSTEM

CROSS-REFERENCE TO RELATED APPLICATION

This application is the National Stage of, and therefore claims the benefit of, International Application No. PCT/US2016/044475 filed on Jul. 28, 2016, entitled "TILTING ANTI-ROTATION SYSTEM," which was published in English under International Publication Number WO 2018/022060 on Feb. 1, 2018. The above application is commonly assigned with this National Stage application and is incorporated herein by reference in its entirety.

TECHNICAL FIELD

This application is directed, in general, to anti-rotation mechanisms and, more specifically, to anti-rotation mechanisms such as may be used in rotary steerable downhole tools.

BACKGROUND

In the oil and gas industry, rotary steerable tools for downhole operations can be used to drill into a formation along a desired path that can change in direction as the tool advances into the formation. Such tools can employ components that brace against the formation to provide a reaction torque to prevent rotation of non-rotating tool portions used as a geostationary reference in steering the rotating portions of the tool.

Such conventional methods and systems have generally been considered satisfactory for their intended purpose. However, there is still a need in the art for improved steerable rotary tools. The present disclosure provides a solution for this need.

BRIEF DESCRIPTION

Reference is now made to the following descriptions taken in conjunction with the accompanying drawings, in which.

DETAILED DESCRIPTION

The present disclosure is based, at least in the part, on the acknowledgment that while many oil/gas downhole drilling tools require a non-rotating outer housing as a geostationary reference to maintain steering control while drilling, that it would be desirable to allow the housing to rotate while tripping out of or tripping into the borehole. For example, in the event that the drilling tool were to get stuck while tripping out of or tripping into the borehole, it would be beneficial to selectively lock the rotation of the housing with the driveshaft, and thus transfer the torque from the driveshaft to the housing to ideally free the drilling tool.

The present disclosure has further acknowledged, however, that existing anti-rotation systems are not designed to selectively allow the housing to rotate within the formation. Specifically, existing anti-rotation systems employ an axial force upon the anti-rotation blades such that the anti-rotation blades are constantly pushed radially outward such that they dig into the formation. With the foregoing acknowledgments in mind, the present disclosure recognizes that it would be beneficial in those instances wherein it is necessary for the housing to rotate within the formation, if the anti-rotation blades could rotate within the housing for protection thereof.

Figure 1:
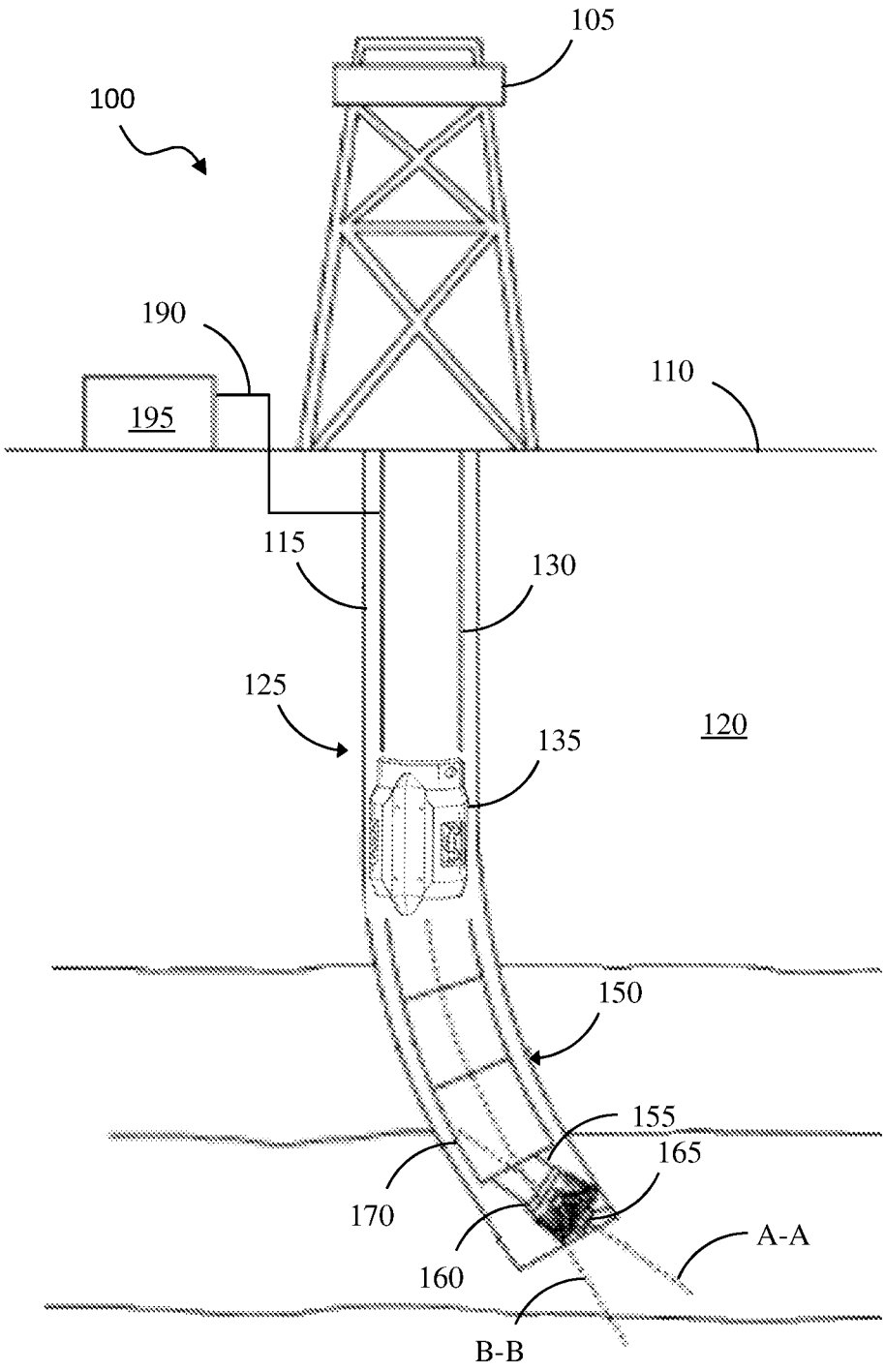
FIG. 1 illustrates an elevation view of an example drilling system according to aspects of the present disclosure.

Reference will now be made to the drawings wherein like reference numerals identify similar structural features or aspects of the subject disclosure. For purposes of explanation and illustration, and not limitation, FIG. 1 illustrates an elevation view of an example drilling system 100 according to aspects of the present disclosure. The drilling system 100 includes a rig 105 mounted at the surface 110 and positioned above borehole 115 within a subterranean formation 120. In the embodiment shown, a drilling assembly 125 may be positioned within the borehole 115 and may be coupled to the rig 105. The drilling assembly 125 may comprise drillstring 130 and anti-rotation system 135, among other items. The drillstring 130 may comprise a plurality of segments threadedly connected to one another.

The drilling assembly 125 may further include a bottom hole assembly (BHA) 150. The BHA 150 may comprise a steering assembly, with an internal driveshaft 155, and a drill bit 160 coupled to the lower end of the BHA 150. The steering assembly 170 may control the direction in which the borehole 115 is being drilled. As will be appreciated by one of ordinary skill in the art in view of this disclosure, the borehole 115 will typically be drilled in the direction perpendicular to a tool face 165 of the drill bit 160, which corresponds to the longitudinal axis A-A of the drill bit 160. Accordingly, controlling the direction in which the borehole 115 is drilled may include controlling the angle of the longitudinal axis A-A of the drill bit 160 relative to the longitudinal axis B-B of the steering assembly 170, and controlling the angular orientation of the drill bit 160 with respect to the steering assembly 170. Furthermore, as those skilled in the art appreciate, the anti-rotation system 135 provides a geostationary reference point for the steering assembly 170.

The drilling system 100 may additionally include any suitable wired drillpipe, coiled tubing (wired and unwired), e.g., accommodating a wireline 190 for control of the steering assembly 170 from the surface 110 during downhole operation. It is also contemplated that the drilling system 100 as described herein can be used in conjunction with a measurement-while-drilling (MWD) apparatus, which may be incorporated into the drillstring 130 for insertion in the borehole 115 as part of a MWD system. In a MWD system, sensors associated with the MWD apparatus provide data to the MWD apparatus for communicating up the drillstring 130 to an operator of the drilling system 100. These sensors typically provide directional information of the drillstring 130 so that the operator can monitor the orientation of the drillstring 130 in response to data received from the MWD apparatus and adjust the orientation of the drillstring 130 in response to such data. An MWD system also typically enables the communication of data from the operator of the system down the borehole 115 to the MWD apparatus. Those skilled in the art will readily appreciate that systems and methods as disclosed herein can also be used in conjunction with logging-while-drilling (LWD) systems, which log data from sensors similar to those used in MWD systems as described herein. In FIG. 1, the MWD/LWD system 195 is shown connected to drillstring 130 by wireline 190.

In operation, the drilling assembly 125 may be advanced downhole through the borehole 115 in the formation 120. In accordance with the disclosure, advancing the drilling assembly 125 downhole may include locking a rotation of the driveshaft 155 with the drillstring 130 (e.g., housing associated with the drillstring 130). When this occurs, in accordance with one aspect of the disclosure, a carriage (not shown) of the anti-rotation system 135 rotates to tuck its anti-rotation blades (not shown) away, and thus protect the anti-rotation blades from damage that might be caused by the formation.

At a point wherein it is desirable for the drilling assembly 125 to begin drilling, the relative rotation of the driveshaft 155 and the drillstring 130 could disengage. When this occurs, friction between the drillstring 130 and the formation 120 would prevent the drillstring 130 from substantial rotation. Accordingly, the anti-rotation blades would have the opportunity to extend back out to the extended position to engage the formation 120.

At a point wherein it is desirable to withdraw the drilling assembly 125 from downhole, a relative rotation of the driveshaft 155 and drillstring 130 could again be locked. When this occurs, the carriage of the anti-rotation system 135 would again rotate to tuck its anti-rotation blades away, and thus protect the anti-rotation blades from damage that might be caused by the formation during the withdrawal process.

Figure 2:
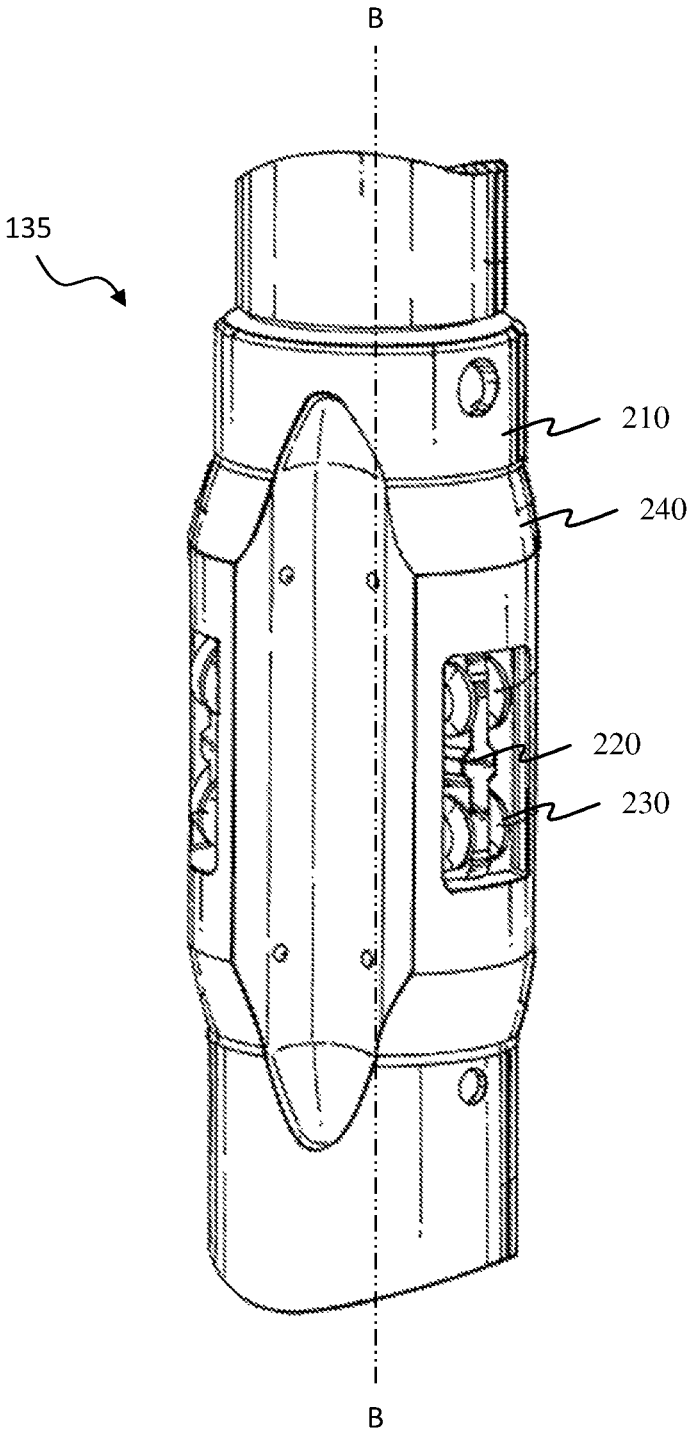
FIG. 2 illustrates a perspective view of the anti-rotation system illustrated in FIG. 1.

FIG. 2 illustrates a perspective view of the anti-rotation system 135 illustrated in FIG. 1. In accordance with the disclosure, the anti-rotation system 135 includes a housing 210. The housing 210, in the embodiment of FIG. 2, is defined by the longitudinal axis B-B, as seen in FIG. 1. Mounted within the housing 210 in the embodiment of FIG. 2 are one or more carriages 220. In the particular embodiment of FIG. 2, the anti-rotation system 135 includes three carriages 220 (two of the three carriages 220 are visible in FIG. 2). In this embodiment, the three carriages 220 may be circumferentially evenly spaced apart around housing 210 by about 120 degrees.

Furthermore to the embodiment of FIG. 2, each carriage 220 has one or more anti-rotation blades 230 configured to engage a formation (e.g., a geological formation), and thereby resist rotation of the housing 210 about the longitudinal axis B-B. In the illustrated embodiment, each of the carriages 220 has four corresponding anti-rotation blades 230. However, those skilled in the art will readily appreciate that any other suitable number of carriages 220 and anti-rotation blades 230 can be used without departing from the scope of this disclosure.

The anti-rotation system 135 illustrated in FIG. 2 further includes a pad body 240. The pad body 240, as is shown in the embodiment of FIG. 2, is operable to maintain the carriage 220 within the housing 210. Specifically, the pad body 240 is operable to resist an axial force being placed upon the carriage 220 from within the housing 210.

Figure 3:
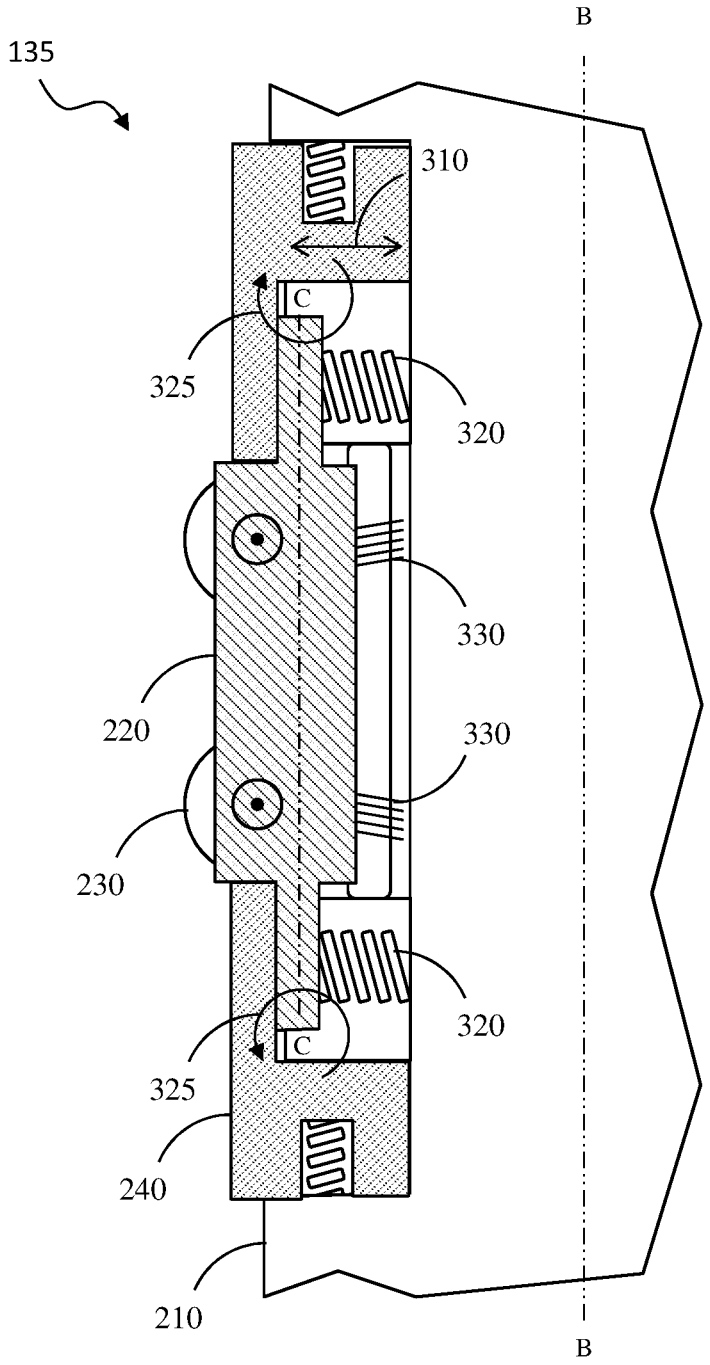
FIGS. 3 through 3E illustrate various different partial section views of different embodiments of the anti-rotation system of FIG. 2 taken through a length of the carriage.

FIG. 3 illustrates a partial sectional view of the anti-rotation system 135 of FIG. 2 taken through a length of the carriage 220. As illustrated in FIG. 3, the carriage 220 is mounted for radial movement (e.g., as shown by the arrow 310) relative to the longitudinal axis B-B of the housing 210. The anti-rotation system 135 further includes one or more load springs 320. The load springs 320, in operation, are connected between the housing 210 and the carriage 220. In this embodiment, the load springs 320 are designed to bias the carriage 220 radially outward to the first extended position. While load springs 320 are illustrated in the embodiments shown, other embodiments may exist where something other than a spring is used to bias the carriage 220 radially outward.

Additionally, in accordance with the disclosure, the carriage 220 of FIG. 3 is configured to rotate (e.g., as shown by the arrows 325) about a carriage axis C-C. In this embodiment, the carriage 220 is operable to tilt the at least one anti-rotation blade 230 from a first extended position (e.g., as shown in FIG. 3) to a second at least partially retracted position (e.g., as shown in FIG. 4) about the carriage axis C-C.

The anti-rotation system 135 illustrated in FIG. 3 further includes an anti-rotation member 330 positioned within the housing 210 proximate the carriage 220. The anti-rotation member 330 is configured to resist the rotation of the carriage 220 about the carriage axis C-C. The anti-rotation member 330 of FIG. 3, or at least the amount of resistance it provides onto the carriage 220, may be tailored such that the carriage 220 may remain in the first extended position when the tool is drilling, but retract when the tool is tripping into or out of the hole. To do this, an amount of resistance the anti-rotation member 330 provides would desirably be greater than the typical drag torque that may exist between the housing of the drillstring 130 and driveshaft 155 (e.g., from bearings, rotating seals, etc.), but less than a torque provided by the formation 120 if the housing of the drillstring 130 and driveshaft 155 were rotationally locked. (See, FIG. 1). Those skilled in the art understand the process of selecting and/or tailoring such an anti-rotation member 330.

Figure 3B:
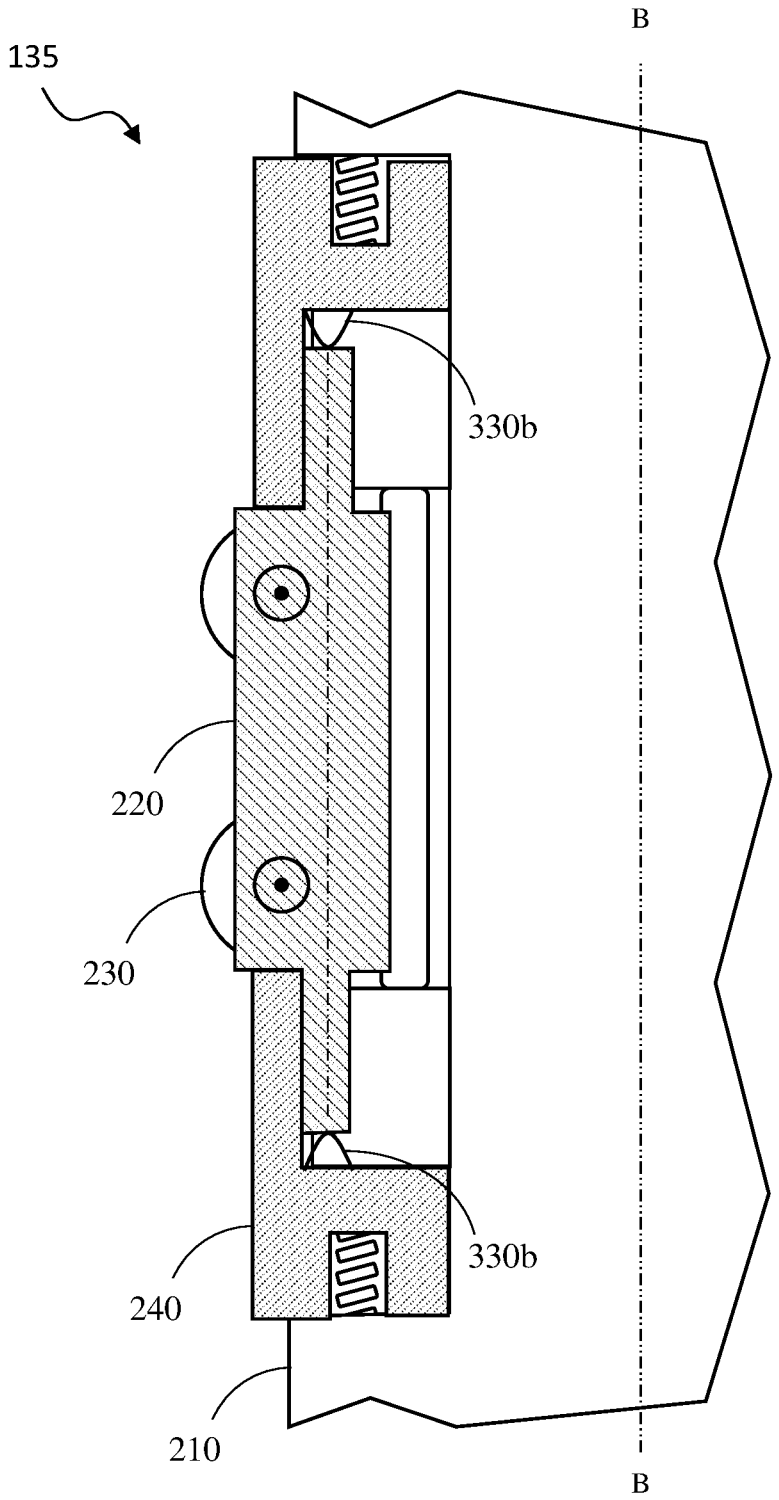
Figure 3C:
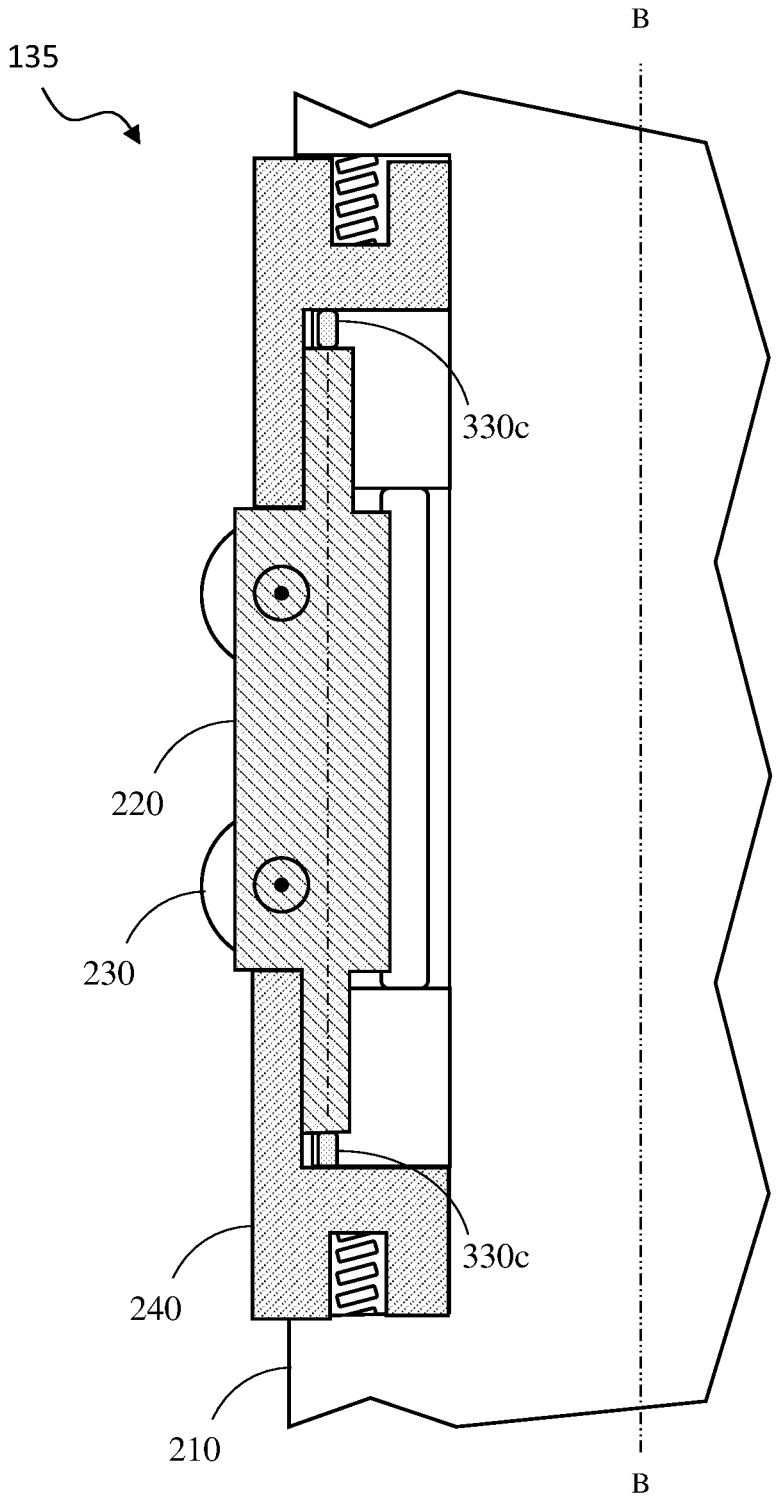
Figure 3D:
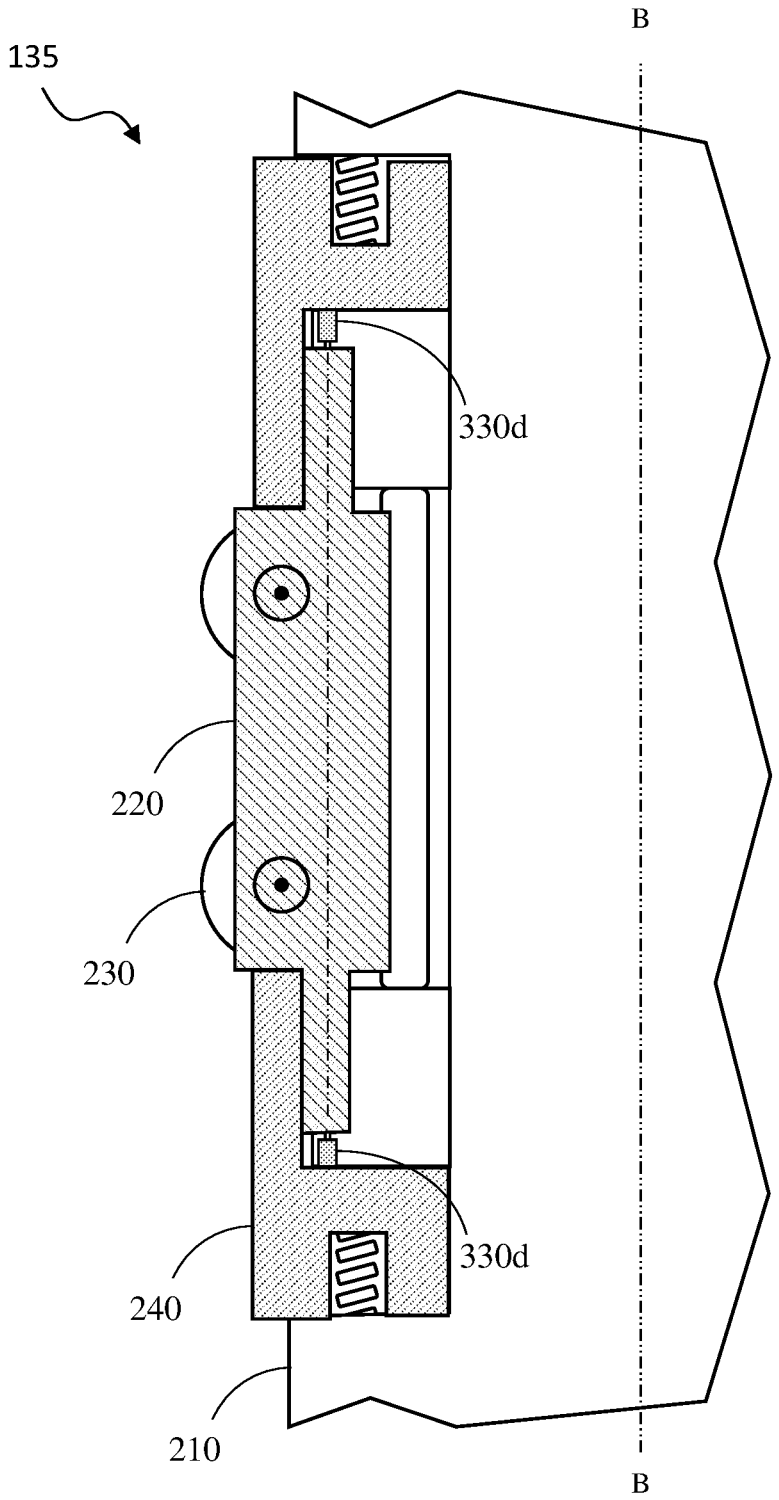
Figure 3E:
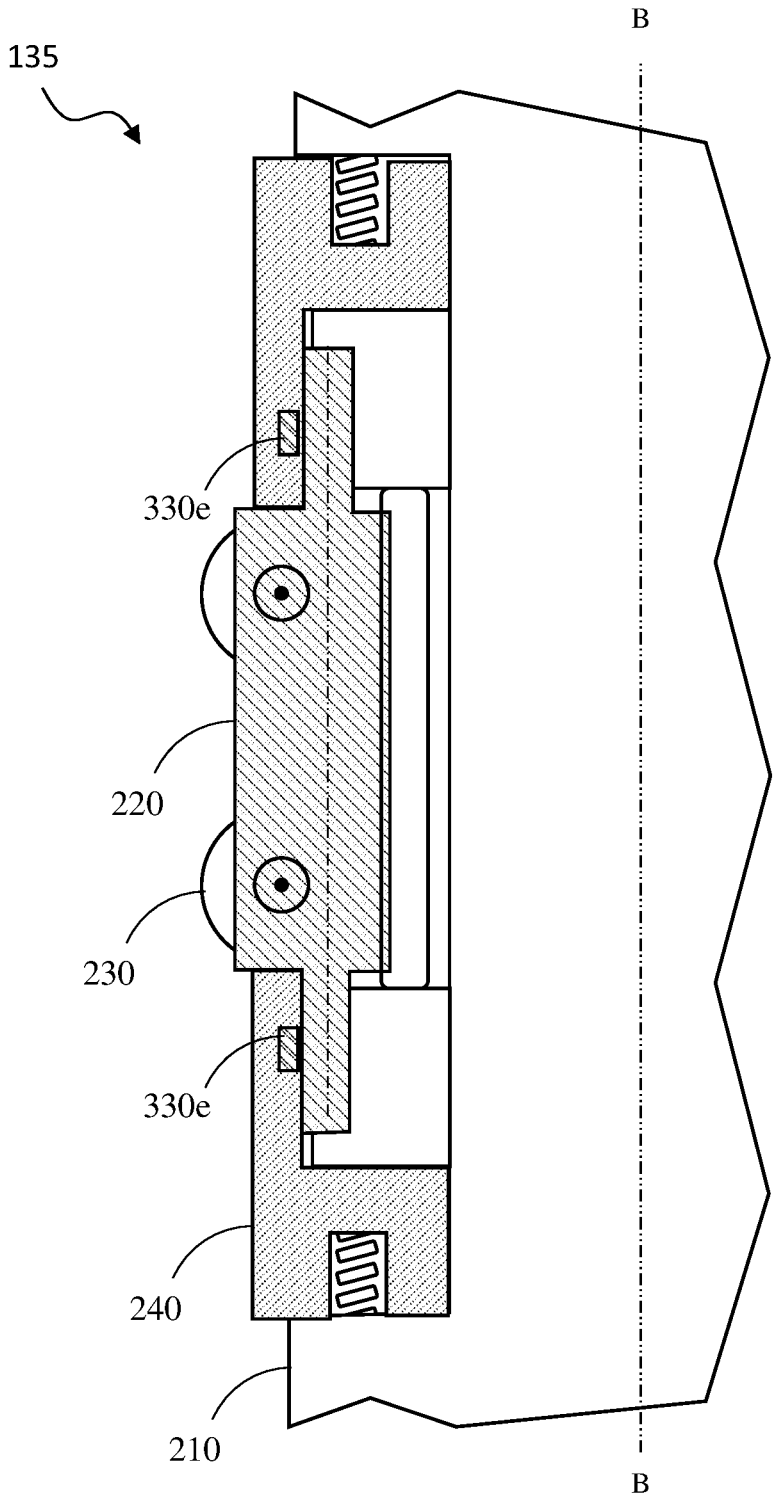

The anti-rotation member 330 is illustrated in FIG. 3 as a torsional spring mechanism. Notwithstanding, other embodiments exist wherein the anti-rotation member 330 is a coil spring mechanism, leaf spring mechanism **330*b* (e.g., FIG. 3B, 4B), or elastomer mechanism 330*c* (e.g., FIG. 3C, 4C), among other possibilities. In one embodiment, the anti-rotation member 330 would provide an appropriate amount of side force onto the side of the carriage 220, such that the carriage 220 and associated anti-rotation blades 230 would not rotate until the side force was overcome. This could also be achieved using a hydraulic mechanism 330*d* (e.g., FIG. 3D, 4D) or electromagnetic mechanism 330*e* (e.g., FIG. 3E, 4**E), among others.

Figure 4:
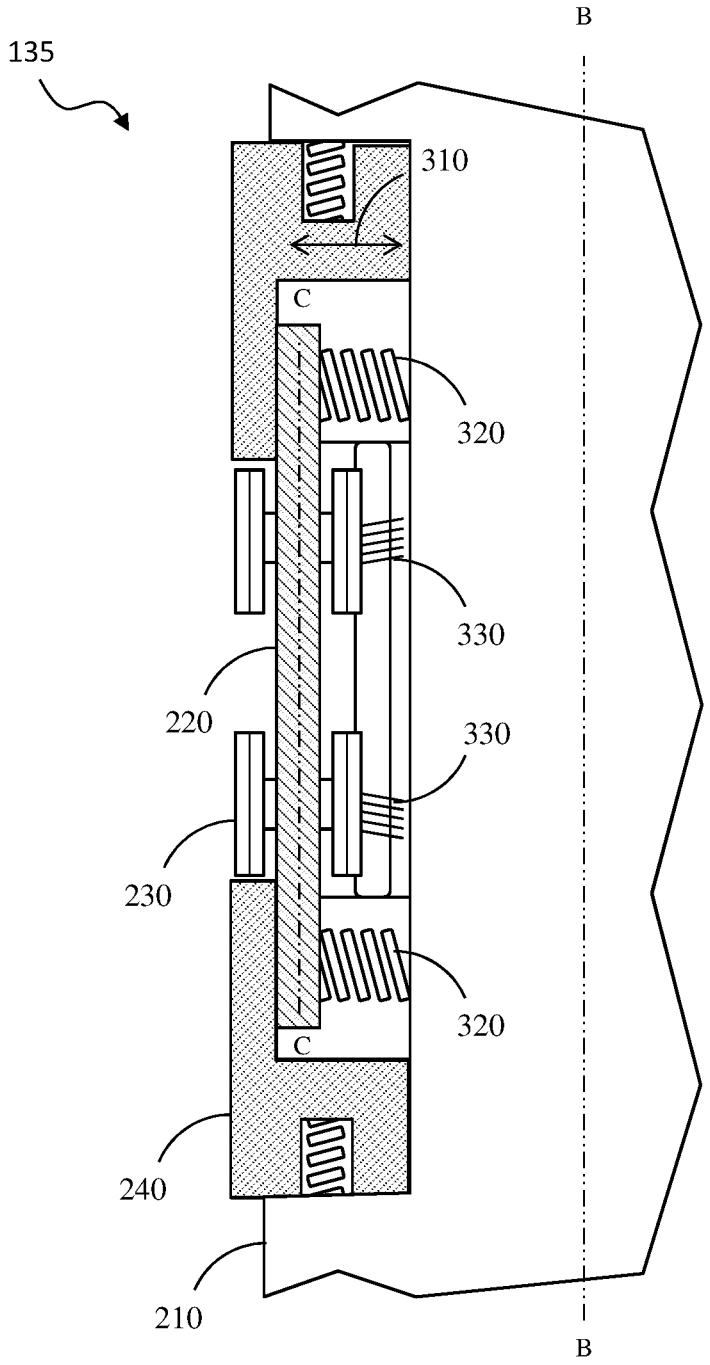
FIGS. 4 through 4E illustrate various different partial section views of different embodiments of the anti-rotation system of FIG. 2 taken through a length of the carriage, with the carriage in the at least partially retracted position.
Figure 4B:
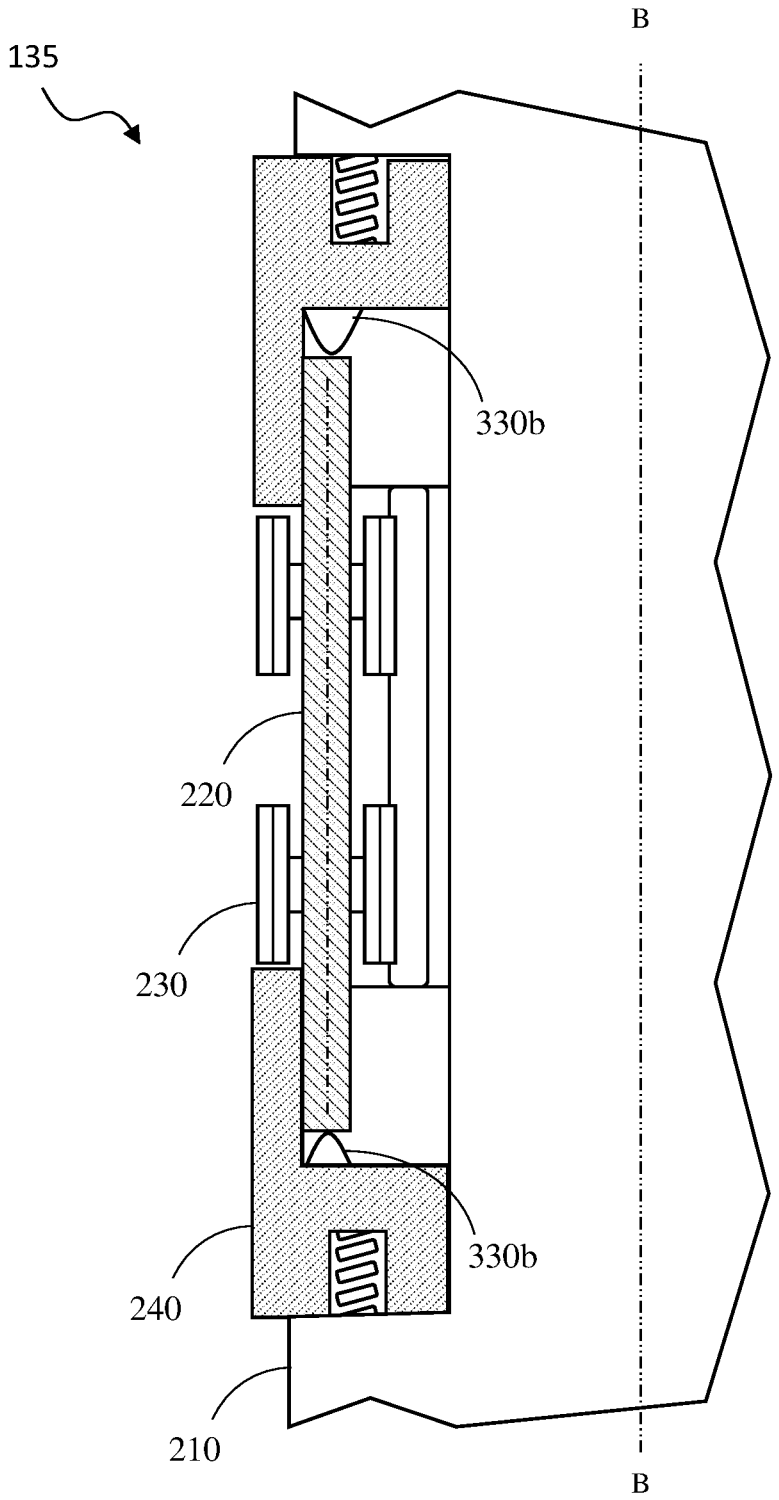
Figure 4C:
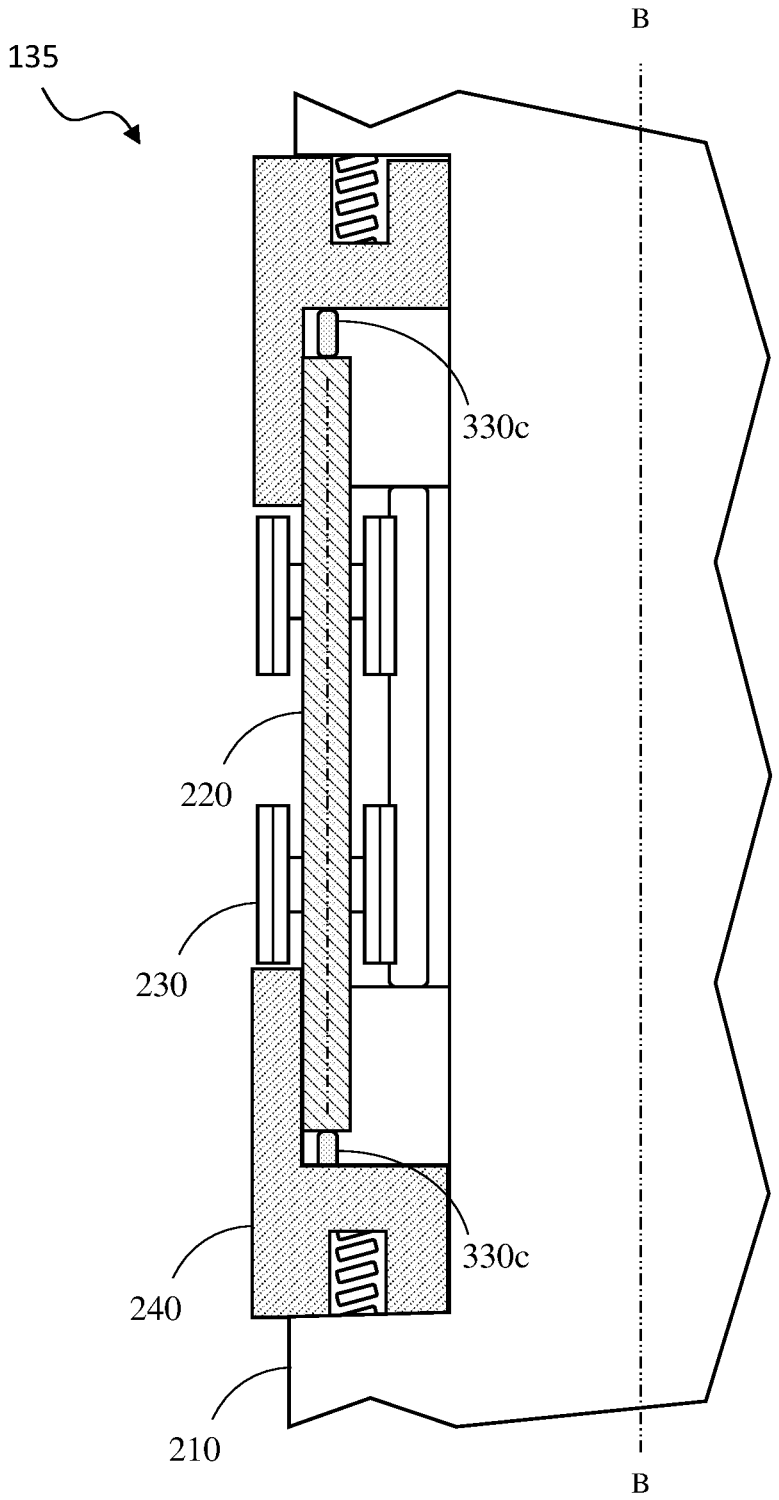
Figure 4D:
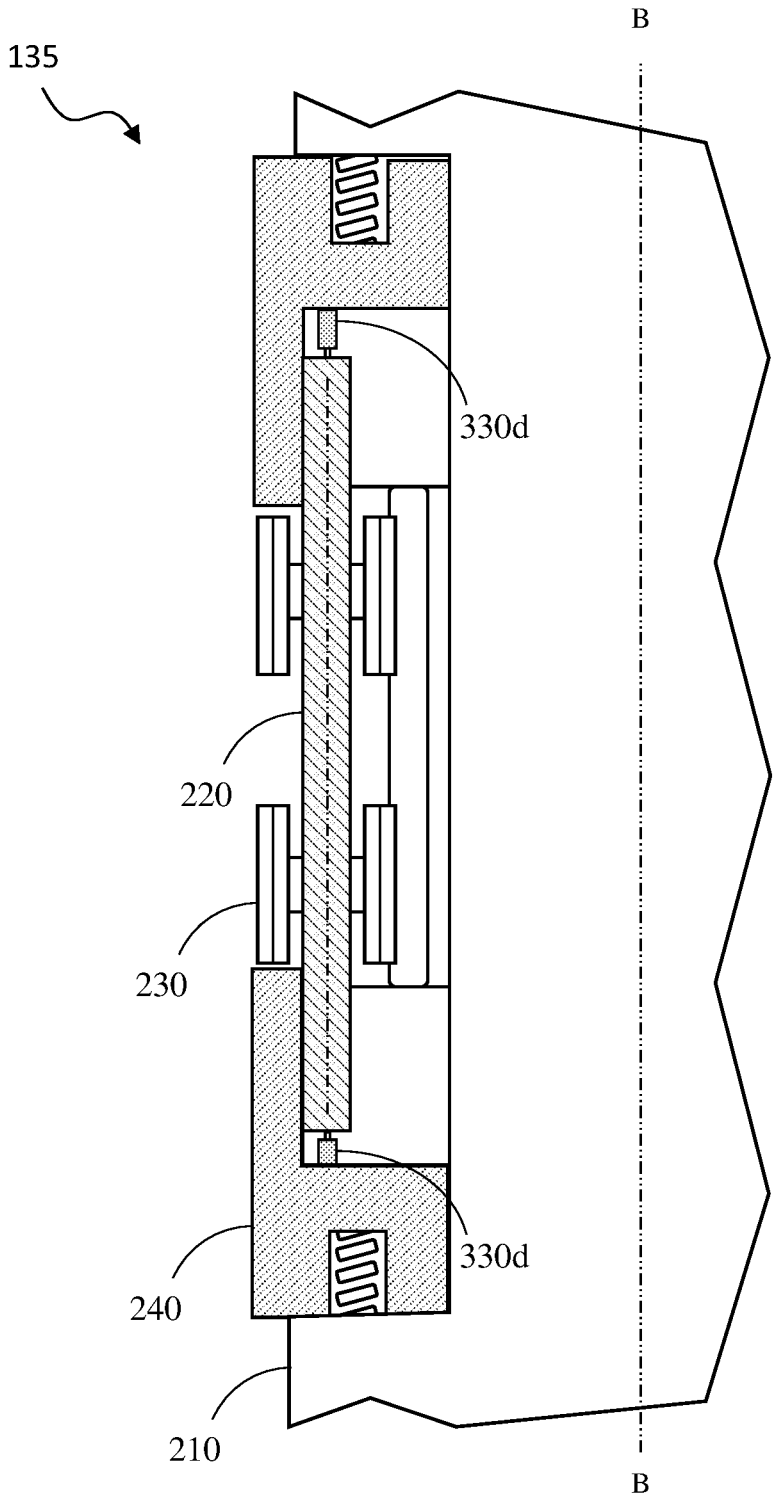
Figure 4E:
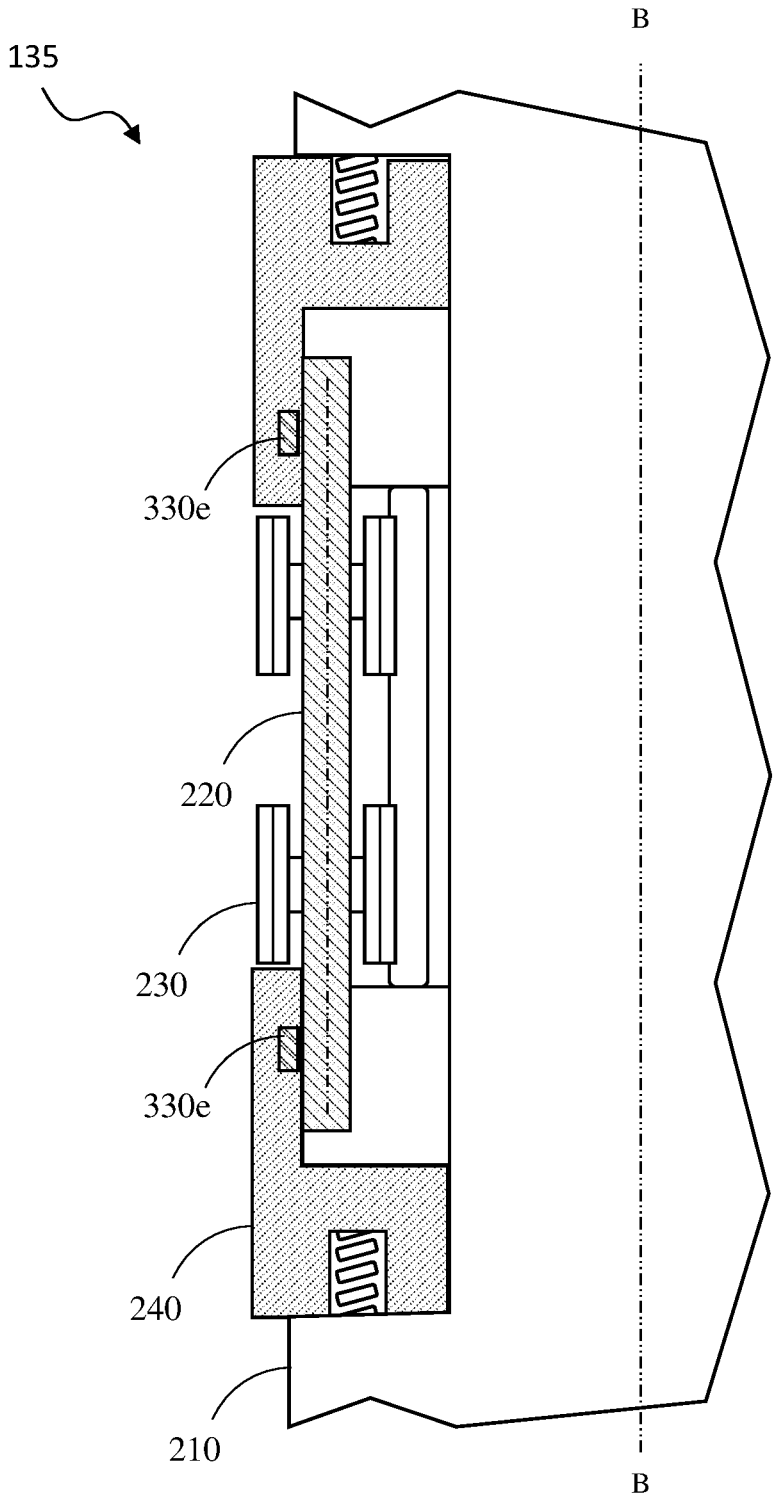

Referring briefly to FIG. 4, illustrated is a partial sectional view of the anti-rotation system 135 of FIG. 2 taken through a length of the carriage 220, with the carriage 220 in the at least partially retracted position. As illustrated, the carriage 220 is rotated about the carriage axis C-C to tilt the one or more anti-rotation blades 230 to the at least partially retracted position. In the embodiment of FIG. 4, the anti-rotation blades 230 are fully retracted. Accordingly, the pad body 240 becomes the point of contact with the formation 120 (FIG. 1).

Figure 5:
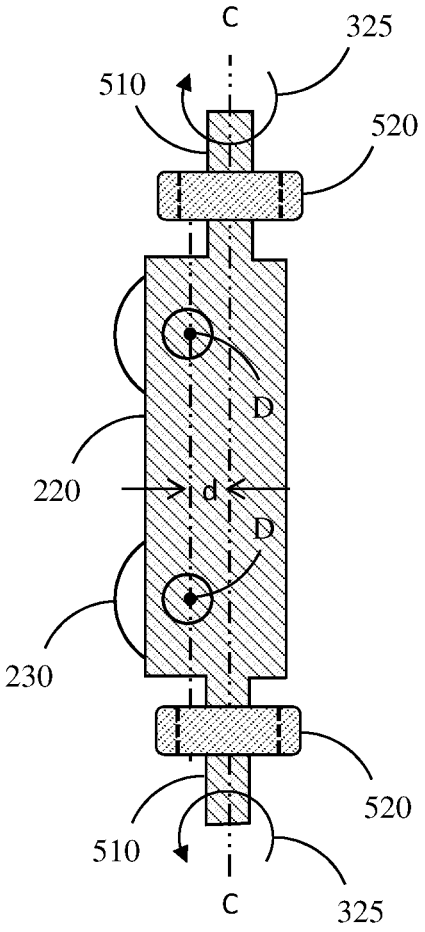
FIG. 5 illustrates a top view of the carriage as removed from the rest of the assembly of FIG. 3.

Referring to FIG. 5, illustrated is a top view of the carriage 220 as removed from the rest of the assembly of FIG. 3. In the illustrated embodiment, the carriage 220 is configured to rotate as shown by arrows 325. The carriage 220 has pivot arms 510 on opposing sides thereof for providing the carriage axis C-C. While the pivot arms 510 are illustrated in FIG. 5 as being circular shafts, other embodiments exist wherein other shapes are employed. For example, another embodiment exists wherein the pivot arms

510 are semi-circular shafts, with the flat portion of the semi-circular shaft positioned radially outward and the rounded portion of the semi-circular shaft positioned radially inward. The rounded bottom surface of the pivot arms 510 allows the carriage 120 to rotate about the carriage axis C-C and tilt the at least one anti-rotation blade 230 from the first extended position to the second at least partially retracted position.

Other embodiments may exist wherein the pivot arms 510 do not employ a rounded bottom surface. In these embodiments, as well as certain embodiments wherein the rounded bottom surface is used, a bearing 520 may be employed (e.g., positioned between one or more load springs 320 and the carriage 220—FIG. 2) to reduce any forces that might affect the ability of the carriage 220 to rotate. Those skilled in the art understand the general purpose, positioning and structure of the bearing 520. Those skilled in the art further understand that other structures, including bushings among other structures, might be used in place of the bearing 520 and remain within the scope of the present disclosure.

In accordance with one embodiment of the disclosure, each one of the at least one anti-rotation blades 230 rotates about its own blade axis D (e.g., extending into the page). In one embodiment, the blade axis D is substantially perpendicular to the carriage axis C-C. In yet another embodiment, the blade axis D and the carriage axis C-C are not located in the same plane, but the blade axis D is offset from the carriage axis C-C by a distance (d). The distance (d) may vary greatly and remain within the purview of the disclosure. Nonetheless, one particular embodiment exists wherein the distance (d) ranges from about 3 mm to about 25 mm. In yet another embodiment, the distance (d) is in a narrower range from about 6 mm to about 18 mm. Likewise, in the embodiment of FIG. 5, the blade axis D is radially outside of the carriage axis C-C. When used in this configuration, the anti-rotation blades 230 are able to tuck within the housing 210 (FIG. 2) without further extending into the formation 120 (FIG. 1) during the tilting process. Notwithstanding the foregoing, other embodiments exist wherein the blade axis D and carriage axis C-C are located in the same plane.

Figure 6:
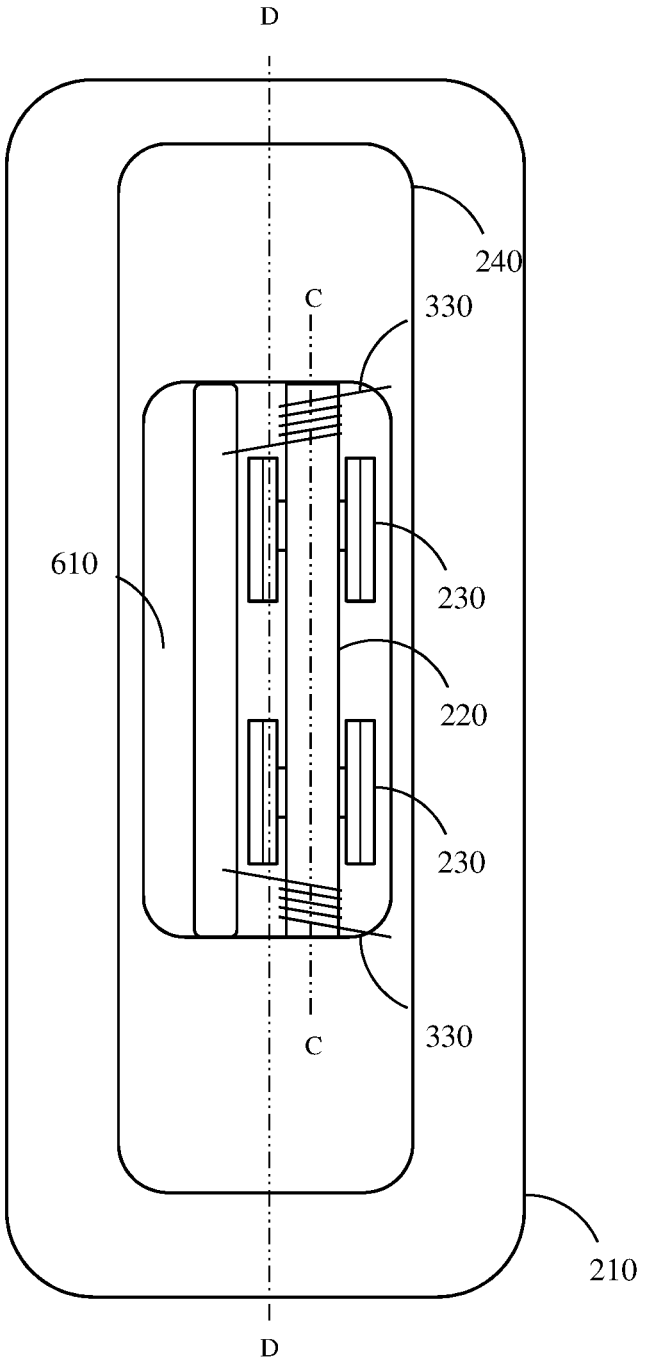
FIG. 6 illustrates a top down view of the carriage of FIG. 2 through an opening in the pad body

FIG. 6 illustrates a top down view of the carriage 220 through an opening 610 in the pad body 240. In the illustrated embodiment, the opening 610 exposes the carriage 220 and one or more anti-rotation blades 230 to the formation 120 (FIG. 1). In one particular embodiment consistent with the disclosure, the carriage 220 is offset from a longitudinal center D-D of the pad body 240. The illustrated configuration is designed to allow the one or more anti-rotation blades 230 to fully tilt and tuck within the pad body 240, such that the pad body 240 will become the point of contact with the formation (e.g., as shown in FIG. 4). Anti-rotation members 330 are additionally illustrated in the view of FIG. 6. As previously discussed, the anti-rotation members 330 are configured to resist the rotation of the carriage 220 about the carriage axis C-C.

Embodiments disclosed herein include:

A. An anti-rotation system, including a housing defining a longitudinal axis, and a carriage mounted within the housing, the carriage including at least one anti-rotation blade configured to engage a formation and resist rotation of the housing about the longitudinal axis, wherein the carriage is configured to rotate about a carriage axis and tilt the at least one anti-rotation blade from a first extended position to a second at least partially retracted position.

B. A method of operating a downhole tool, including advancing a steerable/rotational tool downhole, wherein the tool includes an anti-rotation system. The anti-rotation system, in this method, includes a housing defining a longitudinal axis, and a carriage mounted within the housing, the carriage including at least one anti-rotation blade configured to engage a formation and resist rotation of the housing about the longitudinal axis, wherein the carriage is configured to rotate about a carriage axis and tilt the at least one anti-rotation blade from a first extended position to a second at least partially retracted position. The method further includes rotating the steerable/rotational tool relative to the housing while steering the steerable/rotational tool, the at least one anti-rotation blade in the first extended position to engage a formation to prevent rotation of the housing.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein the carriage has pivot arms on opposing sides thereof for providing the carriage axis. Element 2: wherein the at least one anti-rotation blade rotates about a blade axis that is substantially perpendicular to the carriage axis. Element 3: wherein the blade axis is offset from the carriage axis by a distance (d). Element 4: wherein the distance (d) ranges from about 3 mm to about 25 mm. Element 5: wherein the blade axis is radially outside of the carriage axis. Element 6: further including an anti-rotation member positioned within the housing proximate the carriage to resist rotation of the carriage. Element 7: wherein the anti-rotation member is a torsional spring mechanism. Element 8: wherein the anti-rotation member is selected from the group consisting of a coil spring mechanism, a leaf spring mechanism and an elastomer mechanism. Element 9: wherein the anti-rotation member is selected from the group consisting of a hydraulic mechanism and an electromagnetic mechanism. Element 10: further including a pad body operable to maintain the carriage within the housing. Element 11: wherein the carriage is offset from a longitudinal center of the pad body. Element 12: further including one or more load springs operatively connected between the housing and the carriage to bias the carriage radially outward to the first extended position. Element 13: further including a bushing or bearing positioned between the one or more load springs and the carriage. Element 14: wherein advancing the rotational tool includes rotating the housing within the formation such that the carriage rotates about the carriage axis and tilts the at least one anti-rotation blade to the at least partially retracted position. Element 15: wherein rotating the housing includes locking the rotation of the housing with a rotation of the steerable/rotational tool. Element 16: further including withdrawing the steerable/rotational tool from downhole. Element 17: wherein the withdrawing includes rotating the housing within the formation such that the carriage rotates about the carriage axis and tilts the at least one anti-rotation blade to the at least partially retracted position. Element 18: wherein the anti-rotation system further includes an anti-rotation member positioned within the housing proximate the carriage to resist rotation of the carriage.

The foregoing listed embodiments and elements do not limit the disclosure to just those listed above.

Those skilled in the art to which this application relates will appreciate that other and further additions, deletions, substitutions and modifications may be made to the described embodiments.

What is claimed is:

1. An anti-rotation system, comprising:

a housing defining a longitudinal axis;

a carriage mounted within the housing, the carriage including at least one anti-rotation blade configured to engage a formation and resist rotation of the housing about the longitudinal axis and pivot arms on opposing sides thereof for providing a carriage axis, the carriage and the pivot arms formed from a single unitary piece, wherein the carriage is configured to rotate about the carriage axis and tilt the at least one anti-rotation blade from a first extended position to a second at least partially retracted position;

two or more load springs operatively connected between the housing and the carriage to bias the carriage radially outward to the first extended position; and an anti-rotation member positioned within the housing proximate the carriage to resist rotation of the carriage, wherein the anti-rotation member is a torsional spring mechanism, a coil spring mechanism, a leaf spring mechanism, an elastomer mechanism, a hydraulic mechanism or an electromagnetic mechanism.

2. The anti-rotation system as recited in claim 1, wherein the at least one anti-rotation blade rotates about a blade axis that is perpendicular to the carriage axis.

3. The anti-rotation system as recited in claim 2, wherein the blade axis is offset from the carriage axis by a distance (d).

4. The anti-rotation system as recited in claim 3, wherein the distance (d) ranges from 3 mm to 25 mm.

5. The anti-rotation system as recited in claim 2, wherein the blade axis is radially outside of the carriage axis.

6. The anti-rotation system as recited in claim 1, further including a pad body operable to maintain the carriage within the housing.

7. The anti-rotation system as recited in claim 6, wherein the carriage is offset from a longitudinal center of the pad body.

8. The anti-rotation system as recited in claim 1, wherein the two or more load springs are operatively connected between the housing and the pivot arms to bias the carriage radially outward to the first extended position.

9. The anti-rotation system as recited in claim 8, further including a bushing or bearing positioned between the one or more load springs and the carriage.

* * * * *